US010323654B2

(12) United States Patent
Zhang et al.

(10) Patent No.: US 10,323,654 B2
(45) Date of Patent: Jun. 18, 2019

(54) ELECTRICALLY DRIVEN PUMP

(71) Applicant: Hangzhou Sanhua Research Institute Co., Ltd., Hangzhou, Zhejiang (CN)

(72) Inventors: Rongrong Zhang, Zhejiang (CN); Junfeng Bao, Zhejiang (CN); Chuliang Shi, Zhejiang (CN); Hongmin Song, Zhejiang (CN); Junchao Zhang, Zhejiang (CN); Jun Zhang, Zhejiang (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 380 days.

(21) Appl. No.: 15/073,547

(22) Filed: Mar. 17, 2016

(65) Prior Publication Data

US 2016/0281718 A1 Sep. 29, 2016

(30) Foreign Application Priority Data

Mar. 26, 2015 (CN) ..... 2015 1 0136356

(51) Int. Cl.
*F04D 29/58* (2006.01)
*F04D 13/06* (2006.01)
(Continued)

(52) U.S. Cl.
CPC ..... *F04D 29/588* (2013.01); *F04D 1/00* (2013.01); *F04D 13/0646* (2013.01);
(Continued)

(58) Field of Classification Search
CPC ..... F04D 1/00; F04D 13/064; F04D 13/0646; F04D 13/0693; F04D 29/426;
(Continued)

(56) References Cited

U.S. PATENT DOCUMENTS 5,949,171 A * 9/1999 Horski ..... F04D 29/588 310/179
5,997,261 A * 12/1999 Kershaw ..... F04D 29/588 310/54

(Continued)

FOREIGN PATENT DOCUMENTS

CN 102223010 A 10/2011
CN 103133356 A 6/2013

(Continued)

OTHER PUBLICATIONS

Extended European Search Report, dated Aug. 17, 2016, from corresponding or related European Patent Application No. 16160915.1.

(Continued)

*Primary Examiner* — Patrick Hamo
*Assistant Examiner* — Joseph S. Herrmann
(74) *Attorney, Agent, or Firm* — Wolf, Greenfield & Sacks, P.C.

(57) ABSTRACT

An electrically driven pump includes a first housing and a second housing, and the first housing and the second housing are fixed to form an impeller chamber for receiving an impeller. The second housing and a rear housing are fixed to form a first receiving chamber for receiving a motor assembly; and the motor assembly includes a stator and a rotor, the rotor is arranged in an inner cavity enclosed by the stator, and the rotor drives the impeller to rotate. An electronic control unit is cooperated with the motor assembly, and the electronic control unit controls the operation of the motor assembly. The electrically driven pump includes a cooling passage for accommodating a working medium, and the working medium in the cooling passage may exchange heat with the electronic control unit, thereby facilitating improving the service life of the electrically driven pump.

13 Claims, 9 Drawing Sheets

(51) Int. Cl.
*F04D 1/00* (2006.01)
*F04D 29/42* (2006.01)

(52) U.S. Cl.
CPC ..... *F04D 13/0693* (2013.01); *F04D 29/426* (2013.01); *F04D 29/5806* (2013.01); *F04D 29/5813* (2013.01); *F04D 29/5893* (2013.01)

(58) Field of Classification Search
CPC ..... F04D 29/5806; F04D 29/5813; F04D 29/5866; F04D 29/588; F04D 29/5893; H02K 1/20; H02K 1/32; H02K 9/00; H02K 9/005; H02K 9/05; H02K 9/19; H02K 9/193; H02K 9/197; H02K 2209/00
See application file for complete search history.

(56) References Cited

U.S. PATENT DOCUMENTS 6,065,946 A * 5/2000 Lathrop ..... F04B 49/065 310/43
6,174,143 B1 * 1/2001 Horski ..... F04D 13/0653 277/919
6,986,648 B2 * 1/2006 Williams ..... F04D 13/064 417/370
2004/0062664 A1 * 4/2004 Weigold ..... F04D 13/0626 417/357
2013/0136628 A1 5/2013 Lee et al.
2013/0259720 A1 * 10/2013 Mills ..... F04D 29/5806 417/410.1
2013/0302142 A1 * 11/2013 Chiu ..... F04D 13/0606 415/115

FOREIGN PATENT DOCUMENTS

CN 203130530 U 8/2013
CN 103912524 A 7/2014

OTHER PUBLICATIONS

Chinese First Office Action dated Aug. 27, 2018 in connection with Chinese Application No. 201510136356.2.
Second Office Action for Chinese Application No. 201510136356.2, dated Jan. 17, 2019.

* cited by examiner

ELECTRICALLY DRIVEN PUMP

CROSS REFERENCE TO RELATED APPLICATION

This application claims the benefit of priority to Chinese Patent Application No. 201510136356.2 titled "ELECTRICALLY DRIVEN PUMP", filed with the Chinese State Intellectual Property Office on Mar. 26, 2015, the entire disclosure of which is incorporated herein by reference.

FIELD

This application relates to a centrifugal pump, and relates to an electrically driven pump.

BACKGROUND

In recent decades, automotive industry develops rapidly, and with the development of the automobile towards a direction of safer, more reliable, more stable, fully automatic intellectualization, environment-protecting and energy-saving, electrically driven pumps have gradually replaced conventional mechanical pumps, and have been widely used in vehicle heat dissipating circulating system. The electrically driven pumps have advantages, such as no electromagnetic interference, high efficiency, environmental protection, stepless speed regulation, and can meet the requirements of the market well.

The electrically driven pump has a stator assembly and a rotor assembly completely isolated by a partition, thereby avoiding an issue of liquid leakage in a conventional motor-type brushless direct-current water pump. Currently, an electronic control unit of the electrically driven pump generates heat during operation, and in a conventional design, the electronic control unit is away from a flowing working medium, thus the generated heat is hard to be carried away, which may adversely affect the performance and service life of the electrically driven pump.

Therefore, it is necessary to improve the conventional technology, to address the above technical issues.

SUMMARY

An object of the present application is to provide an electrically driven pump, which facilitates improving the service life of the electrically driven pump.

To achieve the above object, the following technical solutions are adopted in the present application. An electrically driven pump includes a first housing, a second housing, an impeller, a rear housing, a shaft, a motor assembly and an electronic control unit. The electrically driven pump includes a first receiving chamber and an impeller chamber, the impeller or at least most part of the impeller is arranged in the impeller chamber, and the impeller chamber includes a space between the first housing and the second housing; the motor assembly is arranged in the first receiving chamber, and the first receiving chamber includes a space between the second housing and the rear housing. The motor assembly includes a stator and a rotor, and the rotor is configured to drive the impeller to rotate. The electrically driven pump further includes a partition, and the partition separates the first receiving chamber into a stator chamber and a rotor chamber, the rotor chamber is arranged to be closer to a center of the electrically driven pump than the stator chamber, and the stator chamber is not in communication with the impeller chamber. The rotor chamber is in direct or indirect communication with the impeller chamber, and the stator is arranged in the stator chamber, and the rotor is arranged in the rotor chamber. The electronic control unit is configured to control an operation of the motor assembly, and the electronic control unit is electrically connected to the stator. The electrically driven pump further includes a cooling passage, and the cooling passage is in communication with the impeller chamber, the cooling passage includes a first open portion and a second open portion, and the first open portion and the second open portion are located at different positions in a radial direction of the impeller chamber, the first open portion and the second open portion are both in communication with the impeller chamber, the first open portion is arranged away from a center of the impeller chamber in the radial direction with respect to the second open portion, and at least part of a wall of the cooling passage is in direct or indirect contact with the electronic control unit.

Compared with the conventional technology, a cooling passage is provided in the present application, and at least part of the wall of the cooling passage is in direct or indirect contact with the electronic control unit, and the working medium in the cooling passage exchanges heat with the electronic control unit, which facilitates improving the service life of the electronic control unit, and further facilitates improving the service life of the electrically driven pump. Furthermore, the working medium in the cooling passage has a certain pressure difference, such that the working medium may flow in the cooling passage, which facilitates taking away the heat generated by the electronic control unit, to further improve the service life of the electrically driven pump.

DETAILED DESCRIPTION

The present application is further described in conjunction with drawings and embodiments.

Figure 1:
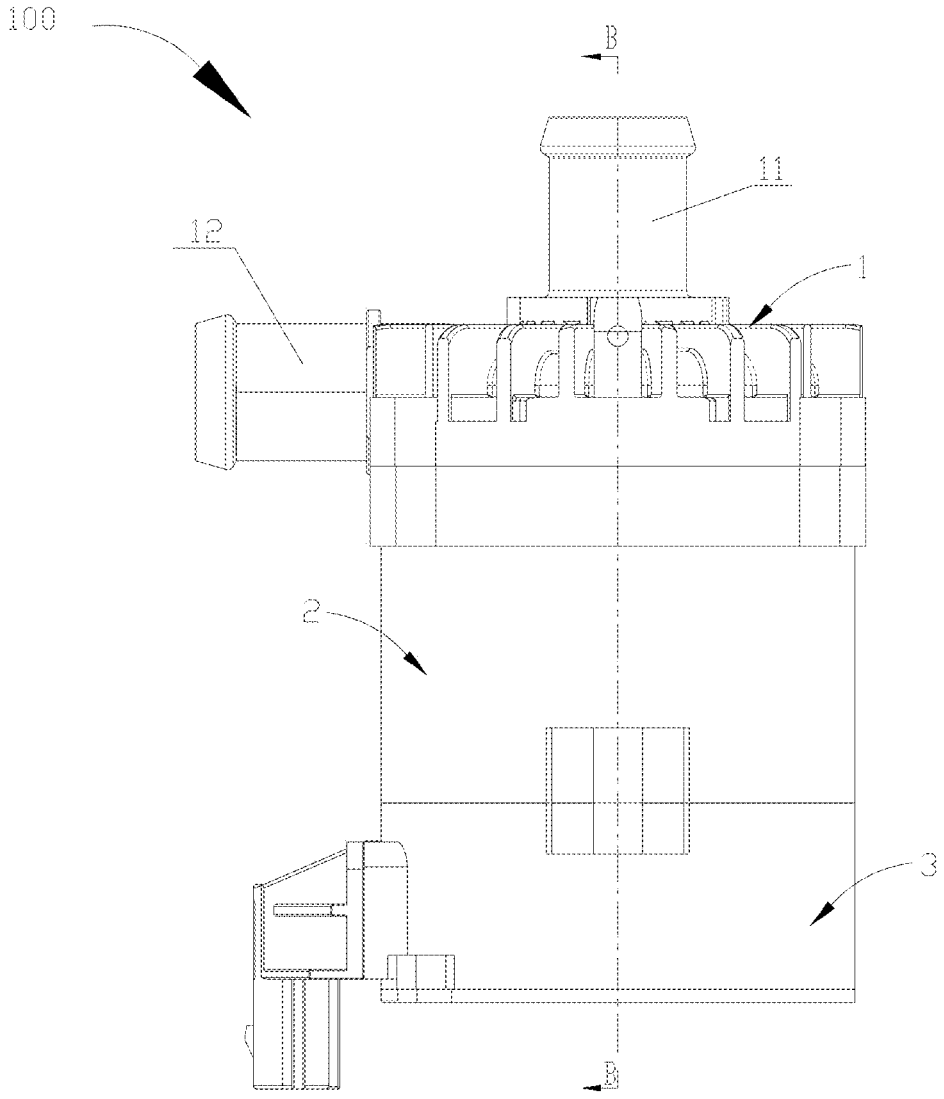
FIG. 1 is a schematic view showing the structure of an embodiment of an electrically driven pump according to the present application.
Figure 2:
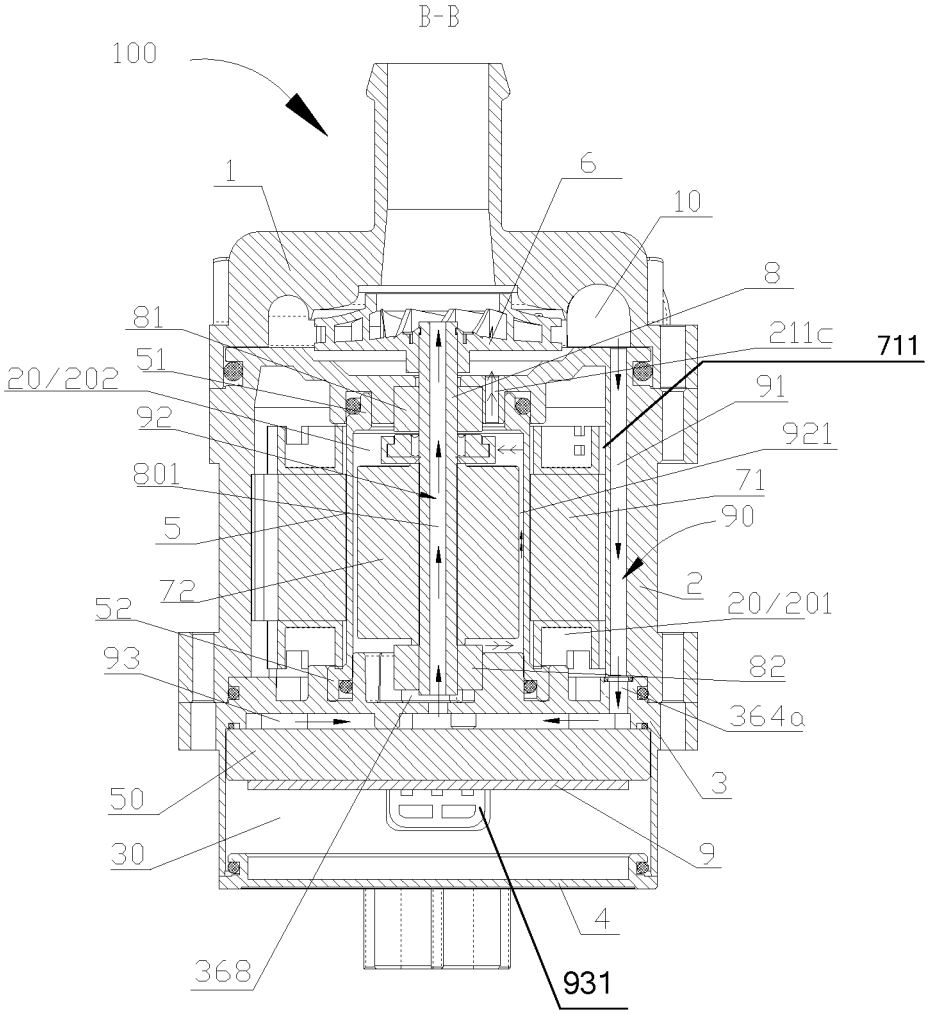
FIG. 2 is a schematic sectional view of a first embodiment of the electrically driven pump in FIG. 1 taken along line B-B.

Referring to FIGS. 1 and 2, an electrically driven pump 100 includes a first housing 1, a second housing 2, a rear housing 3, an end cover 4, an partition 5, an impeller 6, a stator 71, a rotor 72, a pump shaft 8, and an electronic control unit 9. The first housing 1 and the second housing 2 are fixedly connected in a detachable manner and form a relatively sealed structure by arranging a sealing ring at a portion where the first housing 1 and the second housing 2 are connected, and in this embodiment, the first housing 1 and the second housing 2 are connected by a bolt or a screw. An impeller chamber 10 includes a space defined by the first housing 1 and the second housing 2 after being fixed to each other. The impeller 6 is arranged in the impeller chamber 10, and the impeller 6 may make centrifugal movement in the impeller chamber 10. An inlet pipe 11 and an outlet pipe 12 are formed in the first housing 1, the inlet pipe 11 is in communication with the impeller chamber 10, and the outlet pipe 12 is in communication with the impeller chamber 10. The inlet pipe 11 corresponds to a low-pressure part of the pump cavity 10, and the outlet pipe 12 corresponds to a high-pressure part of the pump cavity 10. In this embodiment, the inlet pipe 11 corresponds to a central portion of the impeller chamber 10, and the outlet pipe 12 corresponds to an edge of the impeller chamber 10. The pressure in the impeller chamber 10 is gradually increased in a radial direction from the central portion of the impeller chamber 10 to the edge of the impeller chamber 10. In this embodiment, the outlet pipe 12 may also be arranged in the second housing 2, and is in communication with a portion relatively outwards in the radial direction, in this way, the same effect may be achieved, and the position of the outlet pipe 12 may be chosen according to the process technique. The second housing 2 and the rear housing 3 are threadedly connected, for example, via a bolt, and form the relatively sealed structure through the sealing ring at the connecting part where the second housing 2 and the rear housing 3 are connected. A first receiving chamber 20 includes a space defined by the second housing 2 and the rear housing 3 after being fixed to each other, and the first receiving chamber 20 receives the stator 71 and the rotor 72. The partition 5 separates the first receiving chamber 20 into a stator chamber 201 and a rotor chamber 202, and the stator chamber 201 is not in communication with the impeller chamber 10, and no working medium flows through the stator chamber 201; and the rotor chamber 202 is in direct or indirect communication with the impeller chamber 10, and there may be working medium flowing through the rotor chamber 202. The stator 71 is arranged in the stator chamber 201, and the rotor 72 is arranged in the rotor chamber 202. The shaft 8 is limited or supported by the second housing 2 and the rear housing 3, and an end portion of the shaft 8 protruding into the inside of the impeller chamber 10 is fixed to the impeller 6, and a portion of the shaft 8 located inside the rotor chamber 202 is fixed to the rotor 72. The rotor 72 may rotate under the action of a magnetic excitation field generated by the stator 71 and drive the shaft 8 to rotate, and the shaft 8 drives the impeller 6 to rotate. A second receiving chamber 30 includes a space defined by the rear housing 3 and the end cover 4, and a connecting part where the rear housing 3 and the end cover 4 are connected is provided with a sealing ring to form a relative seal, and the electronic control unit 9 is arranged in the second receiving chamber 30. The electronic control unit 9 includes a circuit board and electronic elements on the circuit board (931), and the electronic control unit 9 is connected to an external circuit and the stator 71. In this embodiment, the connecting part where the first housing 1 and the second housing 2 are connected is provided with the sealing ring, and the connecting part where the second housing 2 and the rear housing 3 are connected is provided with the sealing ring, a sealing ring is provided between the rear housing 3 and the end cover 4, and a sealing ring is provided between each of two ends of the partition 5 and a respective mounting surface. The above sealing rings are configured to ensure the relative seal of the connecting parts. Of course, other sealing methods may also be adopted, for example, welding, welding may enhance the leak tightness, however, for the product of a separated-type structure, using sealing rings to realize the seal between the connecting parts may facilitate detachment and maintenance of the product.

A motor assembly includes the stator 71 and the rotor 72. The stator 71 includes coils, and the rotor 72 is made of a permanent magnet material. Multiple sets of coils of the stator 71 are energized sequentially to generate a varying magnetic excitation field, and the varying magnetic excitation field and a magnetic field generated by a permanent magnet of the rotor 72 attract or repel each other, to allow the rotor 72 to rotate about the central axis of the shaft 8.

The electronic control unit 9 is connected to the motor assembly, and controls the movement of the motor assembly. The electronic control unit 9 analyses and determines the position of the rotor 72 according to the currents of the coils of the stator 71 at the present instant, and sets the currents of the stator 71 at a next instant, to allow the rotor 72 to rotate at a certain speed and in a certain direction.

Figure 3:
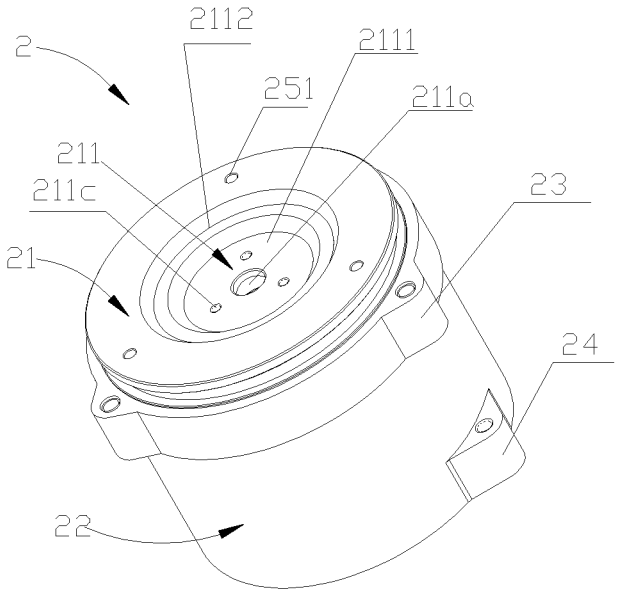
FIG. 3 is a schematic perspective view showing the structure of a second housing of the electrically driven pump in FIG. 2.
Figure 4:
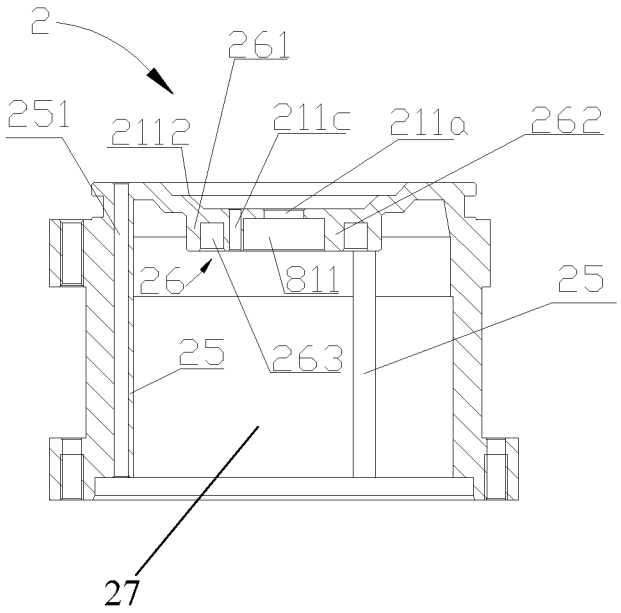
FIG. 4 is a schematic sectional view of the second housing in FIG. 3.

Referring to FIGS. 2, 3 and 4, the second housing 2 includes a top portion 21 and a side wall 22, and an inner cavity (27) of the second housing 2 includes a space between the top portion 21 and the side wall 22. The stator 71 and the rotor 72 are arranged in the inner cavity of the second housing 2. An exterior of the side wall 22 is provided with a first fixing portion 23 and a second fixing portion 24, and the first fixing portion 23 is connected to the first housing 1 via a bolt or a screw, and the second fixing portion 24 is connected to the rear housing 3 via a screw or a bolt. The top portion 21 is provided with a recessed area 211, and the recessed area 211 is formed by being recessed from an outer surface of the top portion 21 towards the inner cavity of the second housing 2. The recessed area 211 includes a space between a recessed bottom portion 2111 and a recessed side wall 2112. A central portion of the recessed bottom portion 2111 is provided with a center hole 211*a*, and the shaft 8 passes through the center hole 211*a* to enter into the impeller chamber 10 from the rotor chamber 202 and to be connected to the impeller 6.

As shown in FIG. 4, an inner surface of the side wall 22 of the second housing 2 is provided with multiple position-limiting members configured to assist in limiting the position of the stator 71. Each of the position-limiting members includes a protruding rib 25 formed by protruding from the inner surface of the side wall towards the inner cavity of the second housing 27. The protruding ribs 25 are substantially evenly distributed on the inner side of the side wall 22 along the circumference of the side wall 22. In this embodiment, the number of the protruding ribs 25 is three. Grooves (711) are formed in a radial outer circumferential surface of an iron core of the stator 71, and after the stator 71 is mounted in the stator chamber 201, the grooves and the protruding ribs 25 form a tight fit, thereby assisting in limiting the rotation of the stator 71 with respect to the second housing 2, and limiting the position of the stator 71 with respect to the second housing 2 more reliably. In this embodiment, an inner surface of the top portion 21 of the second housing 2 is provided with a first mounting portion 26 configured to limit the position of the partition 5, and a first bearing mounting seat 811 configured to limit the position of a first bearing 81 for supporting the shaft 8 or support the first bearing 81. The first mounting portion 26 includes a first annular protrusion 261 and a second annular protrusion 262 arranged on the inner surface of the top portion 21, and a first annular groove 263 formed between the first annular protrusion 261 and the second annular protrusion 262. The first annular groove 263 includes mounting side walls and a mounting bottom wall, and the mounting side walls include an inner surface of the first annular protrusion 261 and an outer surface of the second annular protrusion 262, and the mounting bottom wall is located between the mounting side walls. The partition 5 includes a first mounting segment 51, and the first mounting segment 51 is inserted into the first annular groove 263. A connecting part where the first annular groove 263 and the first mounting segment 51 are connected is provided with a sealing ring, to prevent the working medium in the rotor chamber 202 from entering into the stator chamber 201 via the connecting part between the partition 5 and the second housing 2. The first mounting segment 51 of the partition 5 is provided with a stepped portion configured to limit the position of the sealing ring. Furthermore, a stepped portion may also be provided in the first annular groove 263 to limit the position of the sealing ring, and the object may also be realized. The first bearing mounting seat 811 includes an inner side surface of the second annular protrusion 262, an outer surface of the first bearing 81 is configured to form a tight fit with the inner side surface of the second annular protrusion 262, and an inner surface of the first bearing 81 is configured to be fixedly fitted with an outer surface of the shaft 8.

Figure 5:
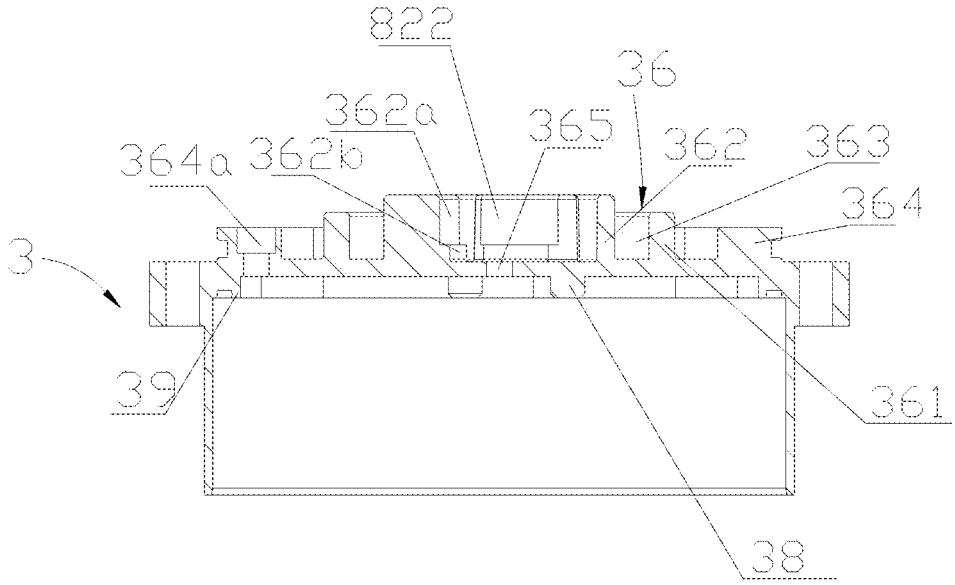
FIG. 5 is a schematic perspective view showing the structure of a rear housing of the electrically driven pump in FIG. 2.
Figure 8:
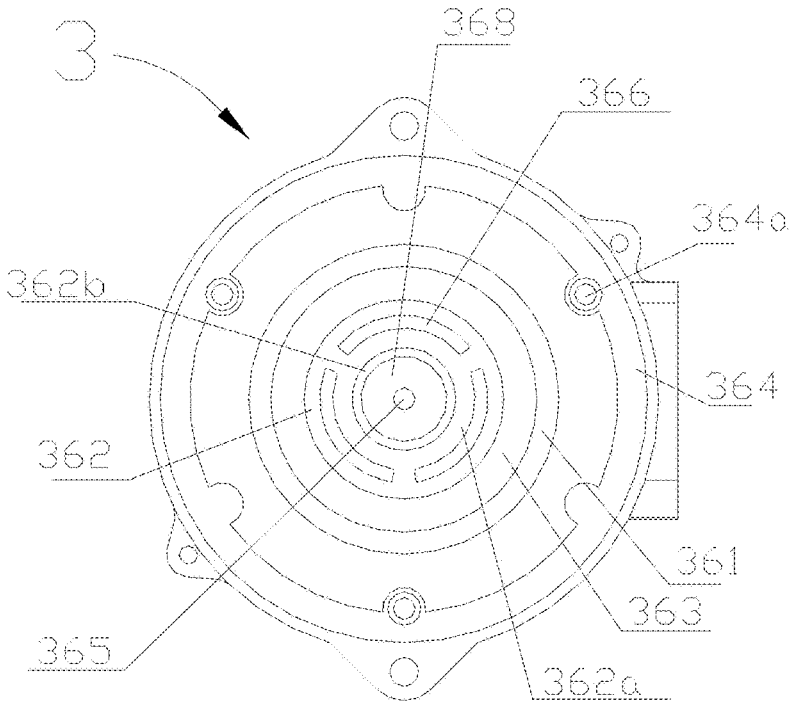
FIG. 8 is a schematic view showing the structure of an upper surface of a second embodiment of the rear housing.

Referring to FIGS. 2, 5 and 8, the rear housing 3 includes an upper surface, a lower surface and a side wall. The upper surface of the rear housing 3 is provided with a second mounting portion 36 configured to limit the position of the partition 5, and a second bearing mounting seat 822 configured to support a second bearing 82 of the shaft 8. The second mounting portion 36 includes a third annular protrusion 361 and a fourth annular protrusion 362 arranged on the upper surface of the rear housing 3, and a second annular groove 363 formed between the third annular protrusion 361 and the fourth annular protrusion 362. The second annular groove 363 includes mounting side walls and a mounting bottom wall, and the mounting side walls include an inner surface of the third annular protrusion 361 and an outer surface of the fourth annular protrusion 362, and the mounting bottom wall is located between the mounting side walls. The partition 5 includes a second mounting segment 52, and the second mounting segment 52 is inserted into the second annular groove 363. The second mounting segment 52 of the partition 5 is provided with a stepped portion configured to limit the position of the sealing ring. The sealing ring is provided in the second annular groove 363 at a connecting part where the second annular groove 363 and the second mounting segment 52 are connected, to prevent the working medium in the rotor chamber 202 from entering into the stator chamber 201 via the connecting part between the partition 5 and the rear housing 3. Furthermore, a stepped portion may also be arranged in the second annular groove 363 to limit the position of the sealing ring, and the object may also be realized.

Figure 6:
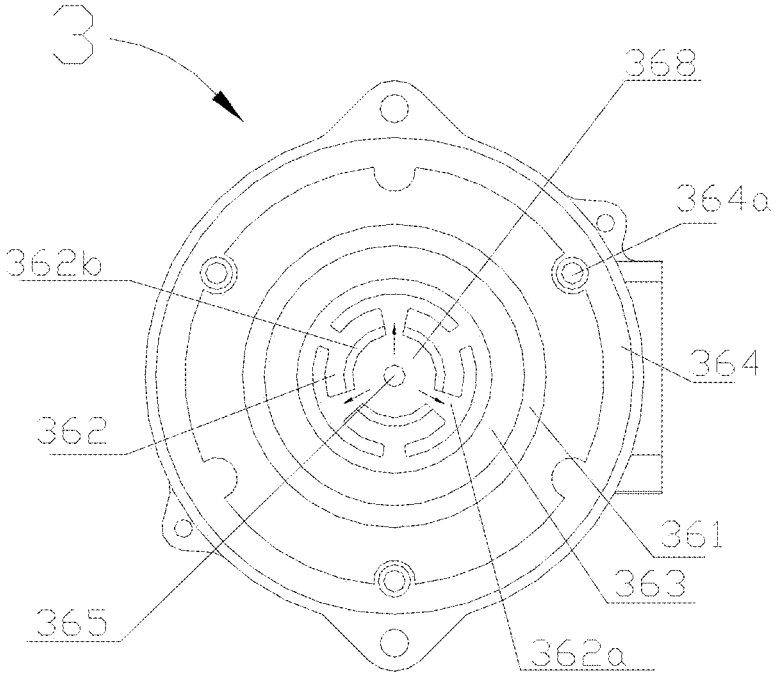
FIG. 6 is a schematic view showing the structure of an upper surface of a first embodiment of the rear housing in FIG. 5.
Figure 7:
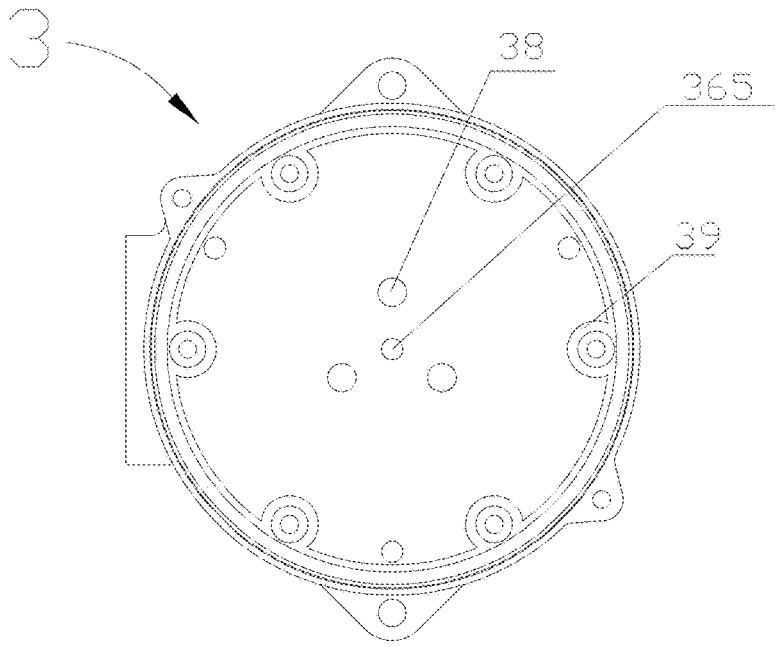
FIG. 7 is a schematic view showing the structure of a lower surface of a first embodiment of the rear housing in FIG. 5.

Reference is made to FIG. 6, which is a schematic view showing the structure of a first embodiment of the upper surface of the rear housing 3. The rear housing 3 includes a flow guiding groove 362*a*. The fourth annular protrusion 362 and the flow guiding groove 362*a* are arranged at interval, and the flow guiding groove 362*a* is in communication with an area enclosed by an inner side surface of the fourth annular protrusion 362. The fourth annular protrusion 362 further includes a stepped portion 362*b*, and the height of the stepped portion 362*b* protruding from the upper surface of the rear housing 3 is lower than the height of the fourth annular protrusion 362 protruding from the upper surface of the rear housing 3. An outer surface of the second bearing 82 is configured to form a tight fit with the inner side surface of the fourth annular protrusion 362, an end surface of the second bearing 82 is configured to abut against an upper surface of the stepped portion 362*b*, and an inner surface of the second bearing 82 is in tight fit with the outer surface of the shaft 8. In this embodiment, in a buffer cavity 368 includes a space that is enclosed by the inner side surface of the fourth annular protrusion 362, the rear housing 3 is provided with an auxiliary hole 365 passing through the upper surface and the lower surface of the rear housing 3. In this embodiment, an outer periphery of the upper surface of the rear housing 3 is further provided with a peripheral protruding annulus 364, and the peripheral protruding annulus 364 is provided corresponding to the position-limiting member of the second housing 2. The peripheral protruding annulus 364 is provided with a communication hole 364*a* passing through the upper surface and the lower surface of the rear housing 3.

As shown in FIG. 2, in this embodiment, the partition 5 is of a cylinder structure with two ends open, and the partition 5 includes a first mounting segment 51 and a second mounting segment 52. A sealing ring is provided between the first mounting segment 51 and the first annular groove 263 arranged in the inner side surface of the top portion 21 of the second housing 2, to form a relative seal structure. A sealing ring is provided between the second mounting segment 52 and the second annular groove 363 arranged in the upper surface of the rear housing 3, to form a relative seal structure. The first mounting segment 51 of the partition 5 is inserted into the first annular groove 263 between the first annular protrusion 261 and the second annular protrusion 262 arranged on the inner side of the top portion 21 of the second housing 2, and the second mounting segment 52 of the partition 5 is inserted into the second annular groove 363 between the third annular protrusion 361 and the fourth annular protrusion 362 arranged on the rear housing 3. In each of the annular grooves, a sealing ring is provided between the partition 5 and the side wall of the annular groove. Of course, the partition 5 may also be a structure with one end open, in this way, the partition 5 may be integrally formed with the second housing 2 or the rear housing 3. The partition 5 is limited in an axial direction via the bottom wall of the first annular groove 263 and the bottom wall of the second annular groove 363. A second receiving chamber 30 is enclosed by the lower surface and the side wall of the rear housing 3 and the end cover 4, and the electronic control unit 9 is arranged in the second receiving chamber 30. The electronic control unit 9 is electrically connected to the stator 71, and a front surface of the electronic control unit 9 is provided with electronic elements, and a back surface of the electronic control unit 9 is in direct contact with a baffle 50 or is in indirect contact with the baffle 50 via a thermal conductive material. The thermal conductive material includes a thermal conductive plate and a thermal conductive adhesive. The baffle 50 may be made of a metal material, to facilitate carrying away the heat generated by the electronic control unit 9. The lower surface of the rear housing 3 is provided with three protrusions 38 and a supporting step 39. The baffle 50 is in contact with the supporting step 39, and the middle portion of the baffle 50 is in contact with the surfaces of the protrusions 38, to ensure that the middle portion of the baffle 50 will not be deformed due to the gravity which may further result in the deformation of the circuit board fixed on the baffle 50. Further, the baffle 50 and the lower surface of the rear housing 3 are relatively sealed, and a communication passage is formed between the baffle 50 and the lower surface of the rear housing 3. In this embodiment, the scale of the thickness of the baffle 50 shown in the drawings does not necessarily indicate the real scale in a practical application, and the choosing of the thickness of the baffle 50 is related to the supporting strength of the material which is specifically used.

As shown in FIG. 2, for further dissipating the heat generated by the electronic control unit 9, the electrically driven pump 100 is provided with a cooling passage 90 for accommodating the working medium, and the electronic control unit 9 generates heat during working and can exchange heat with the working medium in the cooling passage 90. The cooling passage 90 includes a first passage 91, a second passage 92, and a third passage 93. The first passage 91 is in communication with the impeller chamber 10, and the communication portion where the first passage 91 is in communication with the impeller chamber 10 is away from a radial center of the impeller chamber 10. The second passage 92 is in communication with the impeller chamber 10, and the communication portion where the second passage 92 is in communication with the impeller chamber 10 is close to the radial center of the impeller chamber 10. At least part of a wall of the third passage 93 is in direct or indirect contact with the electronic control unit 9. The working medium in the third passage 93 can exchange heat directly or indirectly with the electronic control unit 9. The first passage 91 and the second passage 92 are in communication with each other via the third passage 93. By providing the cooling passage 90, the electronic control unit 9 may exchange heat with the working medium in the cooling passage 90, which facilitates reducing the temperature of the electronic control unit 9, and further improves the service life of the electrically driven pump 100. In this embodiment, the distance between the communication portion of the first passage 91 and the impeller chamber 10 and the radial center of the impeller chamber 10 is greater than the distance of the communication portion of the second passage 92 and the impeller chamber 10 and the radial center of the impeller chamber 10. In this way, when the electrically driven pump 100 is working, the working pressure of the working medium gradually increases from the radial center of the impeller chamber 10 to the edge of the impeller chamber 10, thus, a pressure difference is formed between a first open portion of the cooling passage 90, i.e., the communication portion of the first passage 91 and the impeller chamber 10, and a second open portion of the cooling passage 90, i.e., the communication portion of the second passage 92 and the impeller chamber 10, and due to the pressure difference, the working medium may flow in the cooling passage 90. The single-headed arrows in FIG. 2 schematically show the direction of flowing or flowing tendency of the working medium in the cooling passage 90 when the electrically driven pump 100 is working.

As shown in FIGS. 2 to 4, the first passage 91 includes a passage 251, the passage 251 is formed by extending through an upper surface and a lower surface of the side wall of the second housing 2. Or the passage 251 may be formed by extending through an upper surface and a lower surface of the reinforcing rib 25. Or the passage 251 may be formed a part extending through the upper surface and the lower surface of the reinforcing rib and a part extending through the upper surface and the lower surface of the side wall of the second housing 2. The flow path of the working medium formed by the passage 251 is substantially of a smooth straight linear shape, to reduce the flowing resistance of the working medium and facilitate the flowing of the working medium. The number of the passages 251 is at least one, and the number of the passages 251 is smaller than or equal to the number of the protruding ribs 25. At least one of the passages 251 is arranged or partially arranged in the reinforcing rib 25 arranged relatively close to the edge of the impeller chamber 10, in this way, this passage 251 may be in communication with the outlet of the impeller chamber 10. Three passages 251 are provided in this embodiment and are arranged corresponding to the three reinforcing ribs 25. Of course, the number of the reinforcing ribs 25 may be greater than the number of the passages 251, for example, the number of the reinforcing ribs 25 may be six, and the number of the passages 251 may be three, and the number of reinforcing ribs 25 and the number of the passages 251 may be set as desired.

As shown in FIG. 2, the second passage 92 includes an axial passage 801 arranged in the shaft 8, and the axial passage 801 is arranged along a length direction of the shaft 8 and extends through two ends of the shaft 8. The axial passage 801 is in communication with the impeller chamber 10 at a part close to the center of the impeller chamber 10. Specifically, the maximum radial radius of the impeller chamber 10 is R, and the part where the axial passage 801 is in communication with the impeller chamber 10 is between the center of the impeller chamber 10 and a part displaced from the center of the impeller chamber 10 by one half of the maximum radial radius R. In this embodiment, the axial passage 801 is located at the center of the impeller chamber 10. The flow path of the working medium formed by the axial passage 801 is substantially of a smooth straight linear shape, to reduce the flowing resistance of the working medium and facilitate the flowing of the working medium. The cooling passage 90 may further include a second auxiliary passage 921. The second auxiliary passage 921 includes a flow hole 211*c* arranged in the recessed area 211 of the second housing 2, and the impeller chamber 10 and the rotor chamber 202 are in communication with each other via the flow hole 211*c*. The flow hole 211*c* is arranged near the second passage 92. The flow hole 211*c* is arranged in the second housing 2 between the second passage 92 and a part displaced from the center of the impeller chamber 10 by one half of the maximum radial radius R. In this way, the pressure at a part where the flow hole 211*c* is in communication with the impeller chamber 10 will be slightly greater than the pressure at a part where the second passage 92 is in communication with the impeller chamber 10. The second auxiliary passage 921 has a rather circuitous flow path, which increases the flowing resistance of the working medium, and allows the working medium to better exchange heat with the stator 71. The direction of the double-headed arrows in FIG. 2 schematically shows a direction of flowing or flowing tendency of the working medium in the second auxiliary passage 921, i.e., a direction in which the working medium flows from the third passage 93 to the impeller chamber 10 via the second auxiliary passage 921. In the case that the cross-sectional area of the first passage 91 is large, the working medium is subjected to a small resistance when flowing through the first passage 91, thereby allowing the pressure of the working medium entered into the third passage 93 to be greater than the pressure of the working medium at the part where the flow hole 211*c* is in communication with the impeller chamber 10, and allowing the working medium to flow in the second auxiliary passage 921. If the working medium is subjected to a large flowing resistance in the first passage 91, the pressure of the working medium will drop greatly in the first passage 91, and further the pressure of the working medium in the third passage 93 is lower than the pressure of the working medium at the part where the flow hole 211*c* is in communication with the impeller chamber 10, thus the working medium in the second auxiliary passage 921 flows from the impeller chamber 10 to the third passage 93, and the working medium in the third passage 93 flows into the impeller chamber 10 through the second passage 92.

As shown in FIG. 2, a relative sealing structure is formed between the rear housing 3 and the baffle 50, to form the third passage 93, and the third passage 93 is in communication with the first passage 91 and the second passage 92 via respective communication structures. The wall of the third passage 93 includes the lower surface of the rear housing 3 and the upper surface of the baffle 50. The lower surface of the rear housing 3 and the upper surface of the baffle 50 are configured to be in contact with the working medium. The lower surface of the baffle 50 is in direct contact with the electronic control unit 9 or is in indirect contact with the electronic control unit 9 via a thermal conductive material. The baffle 50 is made of a metal material. The thermal conductive material includes a thermal conductive plate and a thermal conductive adhesive, and is configured to transfer the heat generated by the electronic control unit 9 during working to the working medium in the third passage 93, to carry away the heat by the flowing working medium. For ensuring that the third passage 93 forms a relatively sealed space, wires provided between the electronic control unit 9 and the stator 71 are arranged at the side wall of the rear housing 3 or regions other than the third passage 93.

As shown in FIGS. 2 and 6 to 8, the first passage 91 and the third passage 93 are in communication via a first communication structure, the first communication structure includes a communication hole 364*a* arranged at an edge of the rear housing 3. The communication hole 364*a* may be a straight passage, and may also be an inclined passage. The straight passage can be manufactured conveniently, and the inclined passage may realize a better transition between the first passage 91 and the third passage 93. The second passage 92 and the second auxiliary passage 921 are in communication with the third passage 93 via a second communication structure. The second communication structure includes an auxiliary hole 365 arranged in the rear housing 3 and the buffer cavity 368, and the buffer cavity 368 includes the flow guiding groove 362*a* and a recessed portion enclosed by the inner side surface of the fourth annular protrusion 362.

Figure 9:
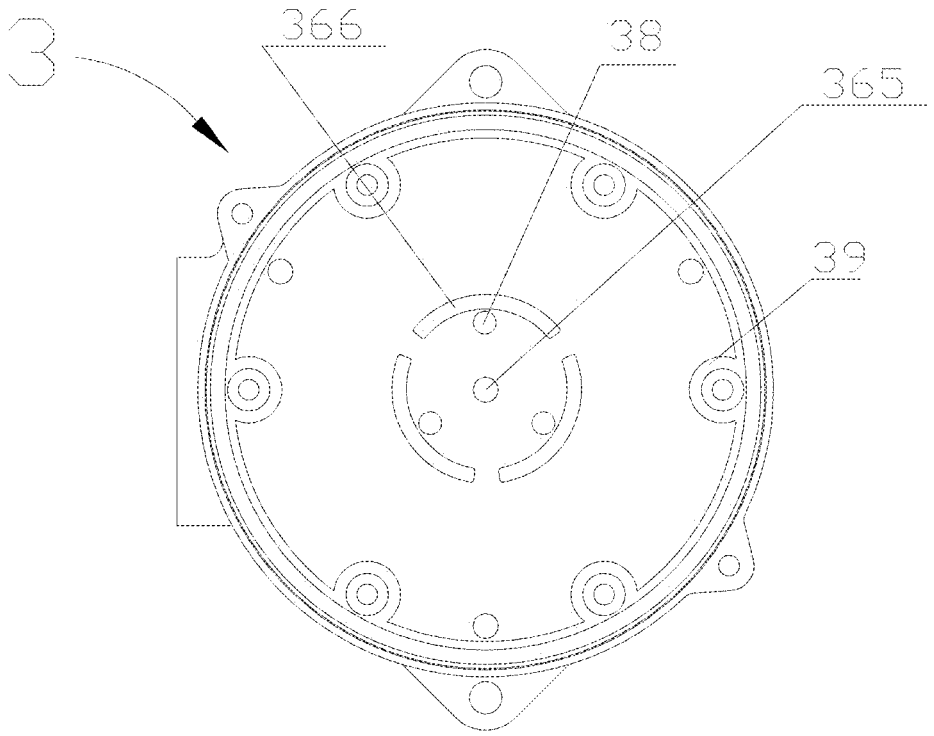
FIG. 9 is a schematic view showing the structure of a lower surface of the second embodiment of the rear housing.

FIGS. 8 and 9 are schematic views showing the structure of a second embodiment of the rear housing 3. Unlike the first embodiment, in the second embodiment, the rear housing 3 is provided with an elongated hole 366 extending through an upper surface and a lower surface of the rear housing 3, and the third passage 93 is in communication with the second auxiliary passage 921 via the elongated hole 366. Of course, the elongated hole 366 may also have other shapes such as multiple circular holes or multiple elliptical holes, and etc. Furthermore, seen from the upper surface of the rear housing 3, the second passage 92 and the second auxiliary passage 921 are in communication with the third passage 93 via a second communication structure. The second communication structure includes an auxiliary hole 365 arranged in the rear housing 3 and a buffer cavity 368, and the buffer cavity 368 includes a recessed portion enclosed by the inner side surface of the fourth annular protrusion 362. The second passage 92 and the second auxiliary passage 921 are no longer in communication with the third passage 93 via a flow guiding groove. The working medium enters into the buffer cavity 368 via the auxiliary hole 365, and the working medium in the buffer cavity 368 enters into the second passage 92. The third passage 93 is in communication with the second auxiliary passage 921 via the elongated hole 366 extending through the rear housing 3.

As shown in FIG. 2, in the first embodiment, when the electrically driven pump 100 is working, since a pressure difference is formed between the first open portion and the second open portion of the cooling passage 90, the pressure at the first open portion of the cooling passage 90 is large, thus the working medium enters into the passage 251 arranged in the second housing 2 via the first open portion of the cooling passage 90, and enters into the third passage 93 formed by the rear housing 3 and the baffle 50 via the communication hole 364*a* arranged in the rear housing 3. The working medium entered into the third passage 93 exchanges heat with the baffle 50 to cool the electronic control unit 9. The working medium after exchanging heat with the baffle 50 enters into the buffer cavity 368 via the auxiliary hole 365 of the rear housing 3, and a part of the working medium entered into the buffer cavity 368 enters into the impeller chamber 10 via the axial passage 801 of the shaft 8, and a part of the working medium enters into the flow guiding groove 362*a*, and then enters into a gap between the rotor 72 and the partition 5, to cool the stator 71. Or, a part of the working medium enters into the second auxiliary passage 921 via the flow hole 211*c* to cool the stator 71, the working medium in the second auxiliary passage 921 enters into the flow guiding groove 362*a*, and the working medium in the flow guiding groove 362*a* and the working medium in the third passage 93 enter into the impeller chamber 10 via the axial passage 801 of the shaft 8. Or, a part of the working medium in the third passage 93 enters into the buffer cavity via the auxiliary hole 365 of the rear housing 3, and then enters into the impeller chamber 10 via the axial passage 801 of the shaft 8, and a part of the working medium in the third passage 93 enters into the second auxiliary passage 921 via the elongated hole 366 of the rear housing 3, and then enters into a relatively medium pressure area of the impeller chamber 10 via the flow hole 211*c* arranged in the recessed area 211 of the top portion 21 of the second housing 2. Or, a part of the working medium enters into the second auxiliary passage 921 via the flow hole 211*c* to cool the stator 71, the working medium in the second auxiliary passage 921 enters into the buffer area, and the working medium in the buffer area enters into the third passage 93 and enters into the impeller chamber 10 via the axial passage 801 of the shaft 8. Since the pressure at a part, corresponding to the axial passage 801 of the shaft 8, of the impeller chamber 10 is lower than the pressure at the part where the flow hole 211*c* is in communication with the impeller chamber 10, thus the working medium more tends to flow back to the impeller chamber 10 from the axial passage 801. The cross-sectional area of the various passages may be matched and the flow resistance may be changed, to ensure that the working medium can flow in the second passage 92 and the second auxiliary passage 921 at the same time, for example, the cross-sectional area of the first passage 91 is greater than the cross-sectional area of the axial passage 801 of the shaft 8, thus the flow rate of the working medium in the first passage 91 is greater than the flow rate of the working medium in the third passage 93, to allow the working medium to enter into the second auxiliary passage 921, i.e., to pass through the gap between the rotor 72 and the partition 5, to better cool the stator 71 and improve the working performance of the electrically driven pump 100. The cooling passage in this embodiment includes the second passage 92 and the second auxiliary passage 921, and may also only include one of the second passage 92 and the second auxiliary passage 921, and the electronic control unit 9 may be cooled as well, and the second auxiliary passage 921 is additionally provided for cooling the stator 71.

Figure 10:
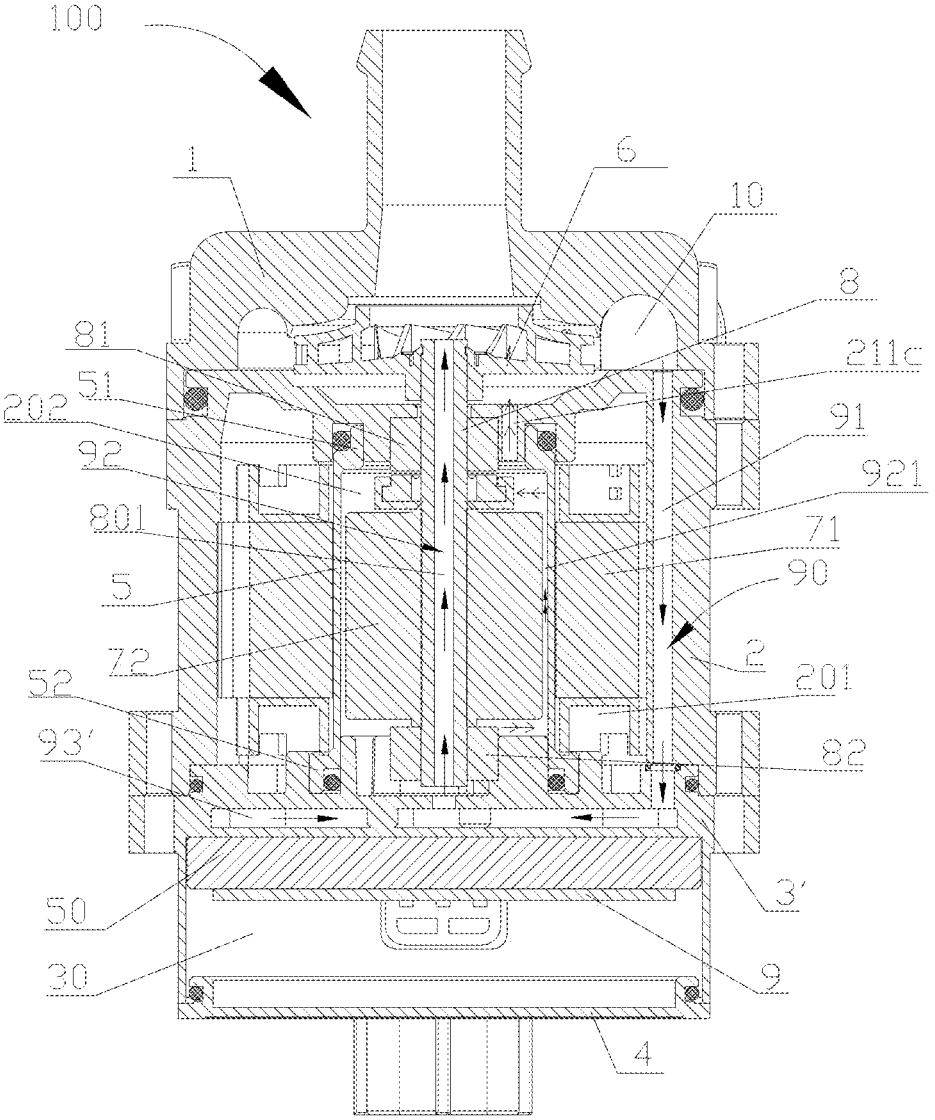
FIG. 10 is a schematic sectional view of a second embodiment of the electrically driven pump in FIG. 1 taken along line B-B.

FIG. 10 is a schematic sectional view of a second embodiment of the electrically driven pump 100 in FIG. 1 taken along line B-B. The electrically driven pump 100 includes a first housing 1, a second housing 2, a rear housing 3', an end cover 4, a partition 5, an impeller 6, a stator 71, a rotor 72, a shaft 8, and an electronic control unit 9. The first housing 1 and the second housing 2 are fixedly connected in a detachable manner and form a relatively sealed structure by arranging a sealing ring at a portion where the first housing 1 and the second housing 2 are connected, and in this embodiment, the first housing 1 and the second housing 2 are connected by a bolt or a screw. An impeller chamber 10 includes a space defined by the first housing 1 and the second housing 2 after being fixed to each other. The impeller 6 is arranged in the impeller chamber 10. The second housing 2 and the rear housing 3' are threadedly connected, for example, via a bolt, and form the relatively sealed structure through the sealing ring at the connecting part where the second housing 2 and the rear housing 3' are connected. A first receiving chamber 20 includes the space defined by the second housing 2 and the rear housing 3 after being fixed to each other, and the first receiving chamber 20 receives the stator 71 and the rotor 72. The partition 5 separates the first receiving chamber 20 into a stator chamber 201, and a rotor chamber 202 which allows the working medium to flow through. The stator 71 is arranged in the stator chamber 201, and the rotor 72 is arranged in the rotor chamber 202. The shaft 8 is limited or supported by the second housing 2 and the rear housing 3', and an end portion of the shaft 8 protruding into the inside of the impeller chamber 10 is fixed to the impeller 6, and a portion of the shaft 8 located inside the rotor chamber 202 is fixed to the rotor 72. The rotor 72 may rotate under the action of an electromagnetic force of the electrically driven pump 100 and drive the shaft 8 to rotate, and the shaft 8 drives the impeller 6 to rotate. A second receiving chamber 30 is defined by the rear housing 3' and the end cover 4, and the electronic control unit 9 is arranged in the second receiving chamber 30. The electronic control unit 9 includes a circuit board and electronic elements on the circuit board, and the electronic control unit 9 is connected to an external circuit and the stator 71. In this embodiment, the connecting part where the first housing 1 and the second housing 2 are connected is provided with the sealing ring, and the connecting part where the second housing 2 and the rear housing 3' are connected is provided with the sealing ring, a sealing ring is provided between the rear housing 3' and the end cover 4, and a sealing ring is provided between each of two ends of the partition 5 and a respective mounting surface. The above sealing rings are configured to ensure the relative seal of the connecting parts. Of course, other sealing methods may also be adopted, for example, welding, welding may enhance the leak tightness, however, for the product of a separated-type structure, using sealing rings to realize the seal between the connecting parts may facilitate detachment and maintenance of the product.

The main difference between this embodiment and the first embodiment of the electrically driven pump 100 shown in FIG. 2 lies in that, the structure of the rear housing 3' is different. The third passage 93 is formed in the rear housing 3', and the circuit board of the electronic control unit 9 is mounted to a lower surface of the rear housing 3' via a baffle 50, the wall of the third passage 93 includes the lower surface of the rear housing 3'; or the circuit board of the electronic control unit 9 is mounted to the lower surface of the rear housing 3' via a thermal conductive material, and the third passage 93 arranged in this way has a good leak tightness, and the sealing structure for the third passage 93 can be omitted, which reduces the production procedures and the assembling parts. In this embodiment, an inlet of the third passage 93 is arranged close to an outer edge of the rear housing 3', and an outlet of the third passage 93 is arranged close to the center of the rear housing 3', the direction in which the working medium flows in the third passage 93 is from the outer edge to the center of the rear housing 3', and in this way, the heat of the electronic control unit 9 may be dissipated better, especially in the case that the electrically pump has only one first passage 91, the power elements of the electronic control unit 9 are arranged close to an area near a connecting line between the inlet and the outlet of the third passage 93. Reference may be made to FIGS. 5 to 9 for other structures of the rear housing 3'.

Figure 11:
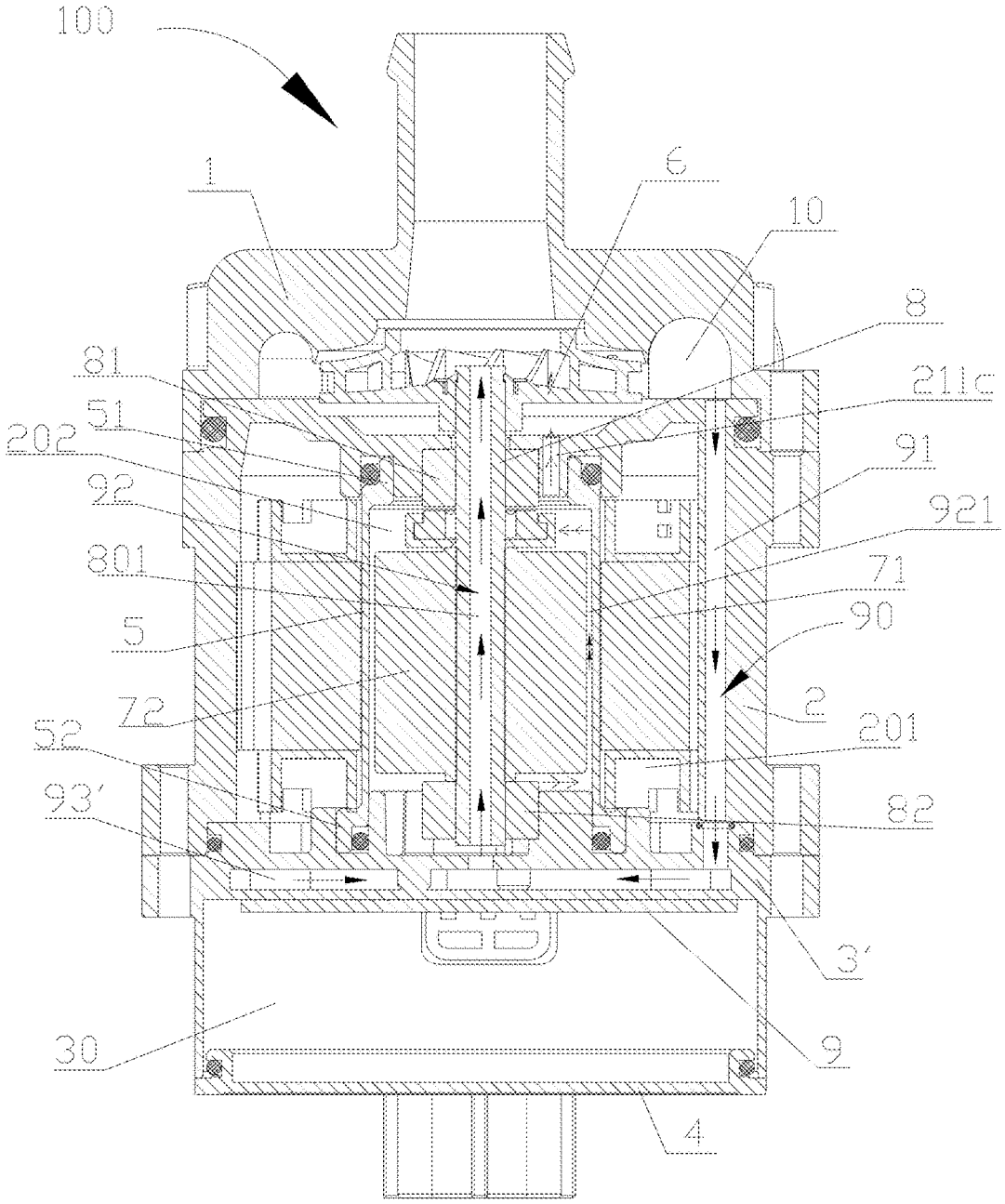
FIG. 11 is a schematic sectional view of a third embodiment of the electrically driven pump in FIG. 1 taken along line B-B.

FIG. 11 is a schematic sectional view of a third embodiment of the electrically driven pump 100 in FIG. 1 taken along line B-B. Unlike the second embodiment of the electrically driven pump 100 shown in FIG. 10, in the third embodiment, the circuit board of the electronic control unit 9 is arranged to be in direct contact with the lower surface of the rear housing 3', or is arranged to be in indirect contact with the lower surface of the rear housing 3' via a thermal conductive material, in this way, the flowing working medium may flow through a third passage 93' to exchange heat with the electronic control unit 9. The wall of the third passage 93 includes the lower surface of the rear housing 3'. Of course, the circuit board of the electronic control unit 9 may also be designed to have a water proof structure, and a third passage 93 may be formed between the circuit board and the lower surface of the rear housing 3'. Thus, when the flowing working medium may flow through the third passage 93 to directly exchange heat with the electronic control unit 9, and carry away the heat, and to further cool the electronic control unit 9. The structures of the electrically driven pump 100 according to this embodiment other than the partition may be referred to the structure of the electrically driven pump shown in FIG. 10.

Figure 12:
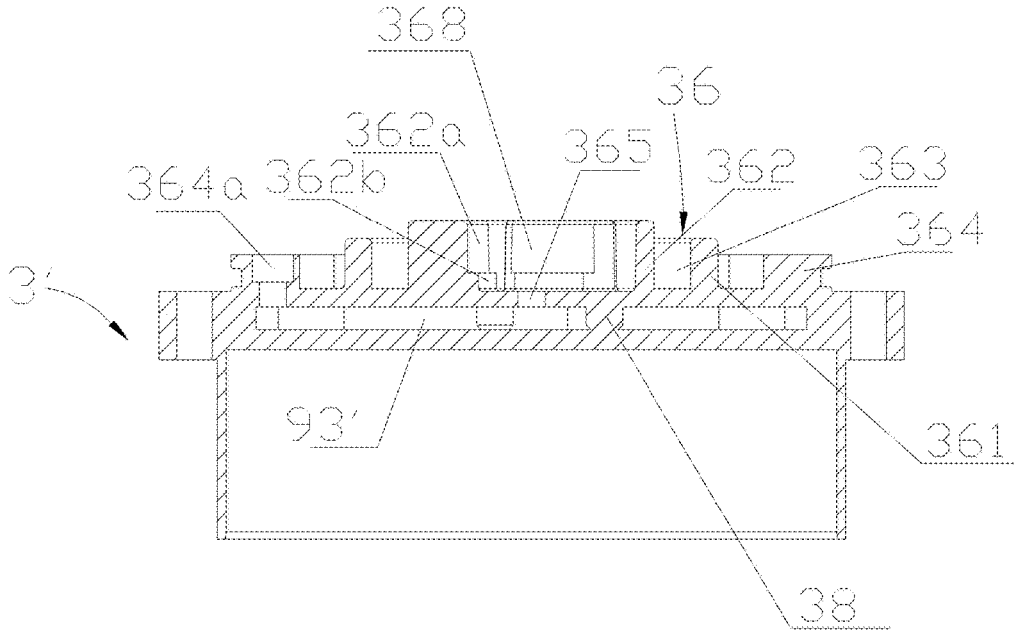
FIG. 12 is a schematic view showing the structure of a rear housing of the electrically driven pump in FIGS. 10 and 11.

FIG. 12 is a schematic view showing the structure of the rear housing 3' in FIGS. 10 and 11. Unlike the rear housing in FIG. 5, in the rear housing 3' in FIGS. 10 and 11, the third passage 93' is arranged in the rear housing 3', and the third passage 93' is a relatively sealed cavity, and is formed by processes such as over molding or injection molding and then assembling. The third passage 93' is in communication with a buffer cavity 368 via the auxiliary hole 365 arranged in the rear housing 3', and a bottom wall of the buffer cavity is a part of the upper surface of the rear housing 3', and a side wall of the buffer cavity 368 is an inner surface of the fourth annular protrusion 362. The wall of the third passage 93 includes the lower surface of the rear housing 3'. The third passage 93' and the second auxiliary passage 912 may be in communication with the buffer cavity via the auxiliary hole 365 or an elongated hole (not shown).

The directions such as "upper" and "lower" in the above embodiments are only for ease of description, and the directions of "upper" and "lower" are not necessarily the directions in a state that the electronic driven pump 100 is mounted, and will not limit the direction of using the electronic driven pump.

It should be noted that, the above embodiments are only intended for describing the present application, and should not be interpreted as limitation to the technical solutions of the present application. Although the present application is described in detail in conjunction with the above embodiments, it should be understood by the skilled in the art that, modifications or equivalent substitutions may still be made to the present application by those skilled in the art; and any technical solutions and improvements of the present application without departing from the spirit and scope thereof also fall into the scope of the present application defined by the claims.

The invention claimed is:

1. An electrically driven pump, comprising a first housing, a second housing, an impeller, a rear housing, a shaft, a motor assembly and an electronic control unit, wherein the electrically driven pump comprises a first receiving chamber and an impeller chamber, the impeller or at least part of the impeller is arranged in the impeller chamber, and the impeller chamber comprises a space between the first housing and the second housing; the motor assembly is arranged in the first receiving chamber, and the first receiving chamber comprises a space between the second housing and the rear housing; the motor assembly comprises a stator and a rotor, and the rotor is configured to drive the impeller to rotate; wherein the electrically driven pump further comprises a first partition, and the first partition separates the first receiving chamber into a stator chamber and a rotor chamber, the rotor chamber is arranged to be closer to a center of the electrically driven pump than the stator chamber, and the stator chamber is not in communication with the impeller chamber, the rotor chamber is in direct or indirect communication with the impeller chamber, and the stator is arranged in the stator chamber, and the rotor is arranged in the rotor chamber; the electronic control unit is configured to control an operation of the motor assembly, and the electronic control unit is electrically connected to the stator; the electrically driven pump further comprises a cooling passage, and the cooling passage is in communication with the impeller chamber, the cooling passage comprises a first open portion and a second open portion, and the first open portion and the second open portion are located at different positions in a radial direction of the impeller chamber, the cooling passage is in communication with the impeller chamber via the first open portion and the second open portion, the first open portion is arranged away from a center of the impeller chamber in the radial direction than the second open portion, and at least part of a wall of the cooling passage is in direct or indirect contact with the electronic control unit;

wherein the cooling passage comprises a first passage, a second passage, and a third passage, the first passage is in communication with the impeller chamber via the first open portion, the second passage is in communication with the impeller chamber via the second open portion, the first passage is in communication with the second passage via the third passage, and at least part of a wall of the third passage is in direct or indirect contact with at least part of the electronic control unit; and the second housing comprises a top portion and a side wall, an inner cavity of the second housing comprises a space enclosed by the top portion and the side wall, the second housing is provided with at least one protruding rib formed from the side wall to the inner cavity, a groove corresponding to the at least one protruding rib is formed in an outer circumference of the stator, and the first passage comprises a passage formed in the at least one protruding rib.

2. The electrically driven pump according to claim 1, wherein the second passage comprises an axial passage formed in the shaft, and the axial passage has one end in communication with a relative central area of the impeller chamber and another end in communication with the third passage.

3. The electrically driven pump according to claim 2, further comprising an end cover and a second receiving chamber, wherein the electronic control unit is arranged in the second receiving chamber, the second receiving chamber comprises a space between the rear housing and the end cover; the first receiving chamber is located between the second receiving chamber and the impeller chamber in an axial direction of the electrically driven pump, and the electrically driven pump further comprises a second partition, and the third passage comprises a relatively sealed passage formed between the second partition and the rear housing, an upper surface of the second partition forms a side wall of the third passage, and a lower surface of the second partition is in direct contact with a circuit board of the electronic control unit or is in indirect contact with the circuit board of the electronic control unit by a thermal conductive material.

4. The electrically driven pump according to claim 2, wherein the first passage is in communication with the third passage via a first communication part, and the first communication part comprises a communication hole arranged in the rear housing; the second passage is in communication with the third passage via a second communication part, and the second communication part comprises a bearing mounting seat arranged on an upper surface of the rear housing, a buffer cavity includes a space enclosed by the bearing mounting seat, and an auxiliary hole is provided to extend through the upper surface and the lower surface of the rear housing, the buffer cavity is in communication with the third passage via the auxiliary hole, and the buffer cavity is in communication with the axial passage of the shaft.

5. The electrically driven pump according to claim 2, wherein a number of the at least one protruding rib is one rib or more than two ribs, and at least one protruding rib, is provided with the passage, is arranged close to an outlet of the impeller chamber, the third passage comprises an inlet and an outlet, and the inlet of the third passage is arranged close to the first passage, and the outlet of the third passage is arranged close to the second passage, at least power elements of an electrical control board are arranged close to a connecting line between the inlet and the outlet of the third passage, or close to an area near the connecting line between the inlet and the outlet of the third passage.

6. The electrically driven pump according to claim 5, wherein the first passage comprises a passage extending through an upper surface and a lower surface of the at least one protruding rib; and the axial passage extends through an upper end surface and a lower end surface of the shaft.

7. The electrically driven pump according to claim 1, further comprising an end cover and a second receiving chamber, wherein the electronic control unit is arranged in the second receiving chamber, the second receiving chamber comprises a space between the rear housing and the end cover; the first receiving chamber is located between the second receiving chamber and the impeller chamber in an axial direction of the electrically driven pump, and the electrically driven pump further comprises a second partition, and the third passage comprises a relatively sealed passage formed between the second partition and the rear housing, an upper surface of the second partition forms a side wall of the third passage, and a lower surface of the second partition is in direct contact with a circuit board of the electronic control unit or is in indirect contact with the circuit board of the electronic control unit by a thermal conductive material.

8. The electrically driven pump according to claim 1, further comprising an end cover and a second receiving chamber, wherein the electronic control unit is arranged in the second receiving chamber, the second receiving chamber comprises a space between the rear housing and the end cover; the first receiving chamber is located between the second receiving chamber and the impeller chamber in an axial direction of the electrically driven pump, and the third passage comprises a passage formed inside the rear housing, the electrically driven pump comprises a second partition, and a main body of the second partition is made of metal material, an upper surface of the second partition is in direct contact with a part, provided with the third passage, of the rear housing, and a lower surface of the second partition is in direct contact with a circuit board of the electronic control unit or is in indirect contact with the circuit board of the electronic control unit by a thermal conductive material.

9. The electrically driven pump according to claim 1, further comprising an end cover and a second receiving chamber, wherein the electronic control unit is arranged in the second receiving chamber, the second receiving chamber comprises a space between the rear housing and the end cover; the first receiving chamber is located between the second receiving chamber and the impeller chamber in an axial direction of the electrically driven pump, and the third passage comprises a passage formed inside the rear housing, the electronic control unit comprises a circuit board and electronic elements arranged on the circuit board, the electric elements are arranged on a lower surface of the circuit board, and an upper surface of the circuit board is in direct contact with a lower surface of the rear housing or is in indirect contact with the lower surface of the rear housing via a thermal conductive material.

10. The electrically driven pump according to claim 1, wherein the first passage comprises a passage extending through an upper surface and a lower surface of the at least one protruding rib.

11. The electrically driven pump according to claim 1, wherein the cooling passage further comprises a second auxiliary passage, and the second auxiliary passage is in communication with the third passage and the impeller chamber; the second auxiliary passage comprises a gap between the rotor and the first partition, and a flow hole extending through a top portion of the second housing, and in the radial direction of the impeller chamber, a distance between the flow hole and the center of the impeller chamber is smaller than a distance between the first open portion of the cooling passage and the center of the impeller chamber, and is greater than a distance between the second open portion and the center of the impeller chamber.

12. The electrically driven pump according to claim 11, wherein the second auxiliary passage is in communication with the third passage via a third communication part, the third communication part comprises a flow guiding groove, and the buffer cavity in communication with the gap between the rotor and the first partition via the flow guiding groove.

13. The electrically driven pump according to claim 11, wherein the second auxiliary passage is in communication with the third passage via a third communication part, the third communication part comprises a through hole arranged in the rear housing.

* * * * *